United States Patent [19]

Laiche et al.

[11] 4,055,337

[45] Oct. 25, 1977

[54] SPRING ASSEMBLY AND CLIP

[75] Inventors: Emile J. Laiche, Park Forest, Ill.; Russell E. Jones, Hialeah, Fla.

[73] Assignee: Nachman Corporation, Des Plaines, Ill.

[21] Appl. No.: 610,107

[22] Filed: Sept. 4, 1975

[51] Int. Cl.[2] ..... A47C 23/04; F16F 3/04

[52] U.S. Cl. ..... 267/101; 5/259 R; 24/81 CC; 267/105

[58] Field of Search ..... 267/100, 101, 105, 107; 24/81 B, 81 CC; 5/259 R, 259 B, 267, 270, 273, 275; 140/3 CA

[56] References Cited

U.S. PATENT DOCUMENTS

| | | | |
|---|---|---|---|
| 568,101 | 9/1896 | Rouse | 5/259 R X |
| 630,968 | 8/1899 | Brouyette | 5/259 R X |
| 1,139,892 | 5/1915 | Miller et al. | 5/259 B X |
| 1,155,425 | 10/1915 | King | 5/259 R |
| 2,961,667 | 11/1960 | Rymland | 5/267 X |

FOREIGN PATENT DOCUMENTS

| | | | |
|---|---|---|---|
| 563,697 | 1/1958 | Belgium | 5/259 R |

*Primary Examiner*—Johnny D. Cherry
*Attorney, Agent, or Firm*—McDougal, Hersh & Scott

[57] ABSTRACT

A spring clip for interconnecting coil springs with tie wires to maintain the coil springs in spaced lengthwise and crosswise rows in the spring assembly, in which the clip member spans the adjacent chords of the terminal coils of the coil springs and receives the adjacent tie wires and the adjacent portions of the terminal coils of the coil springs in respective inwardly and outwardly facing channels with a tongue for leading the clip member into the assembled relation.

4 Claims, 4 Drawing Figures

SPRING ASSEMBLY AND CLIP

This invention relates to spring assemblies such as employed in box springs and mattresses, and relates more particularly to elements employed in the manufacture of same.

In U.S. Pat. No. 2,961,667, issued on Nov. 29, 1960, description is made of a spring cushion assembly formed of multiple helically shaped coil springs arranged in crosswise and lengthwise rows, with helical springs being maintained in the aligned rows by means of tie wires aligned to engage adjacent terminal portions of the outermost coils of adjacent coil springs in the rows, and clip means operatively interconnecting the adjacent coils with the tie wires for maintaining the coil springs in the desired spaced relation to define the rows.

Each clip means comprises a unitary metal strip having a flat central body portion dimensioned to have a length corresponding to the spaced relation between adjacent tie wires of successive rows, with the strip being formed at its ends in a manner to interconnect adjacent tie wires with the terminal coils of the adjacent coil springs. For this purpose, the ends of the strips were formed with a reversely bent portion that led into a flat portion which extends inwardly for a shirt distance in spaced parallel relation with the body portion to define inwardly facing channels through which the tie wires extended. The inwardly extending portion continued into a short downwardly extending portion that terminated into a horizontally disposed inwardly extending tab end portion which, with the downwardly extending portion, defined an outwardly facing channel which was engaged by the terminal coil of the interconnected coil spring.

The assembly to interconnect the tie wires and the terminal coils of the coil springs, by means of the clip members, is a rather complicated procedure and the terminal coils of the coil springs are not sufficiently secured in the assembled relation to retain the coil springs in the assembly, especially when the terminal coils of the coil springs are disfigured or deviation occurs in their dimensions.

Thus it is an object of this invention to produce and to provide a method of producing a multiple coil spring assembly of the type described, in which use is made of a locking clip for interconnection of cross tie wires with terminal coils of coil springs aligned and crosswise extending, spaced apart rows and lengthwise extending spaced apart rows, in which the clip embodies means to ease the assembly, and which includes means for more securely retaining the terminal coils of the coil springs in their assembled relation in interconnection with the tie wires.

These and other objects and advantages of this invention will hereinafter appear and, for purposes of illustration, but not of limitation, an embodiment of the invention is shown in the accompanying drawings in which.

Figure 1:
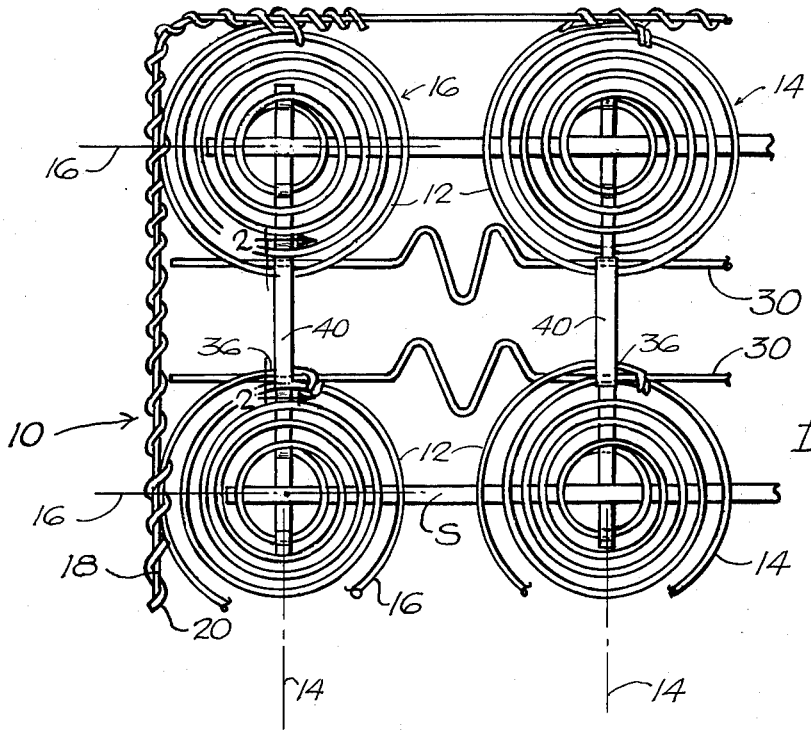
FIG. 1 is a top plan view of a corner portion of a corner spring assembly in which use is made of clip members embodying the features of this invention.
Figure 2:
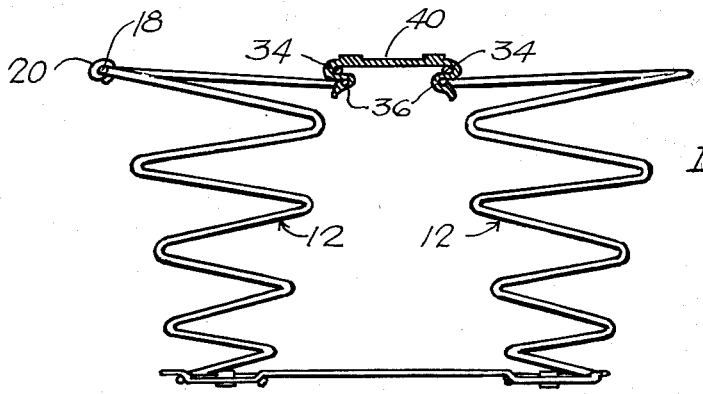
FIG. 2 is an elevational view, partially in section, taken along the line 2—2 of FIG. 1.
Figure 3:
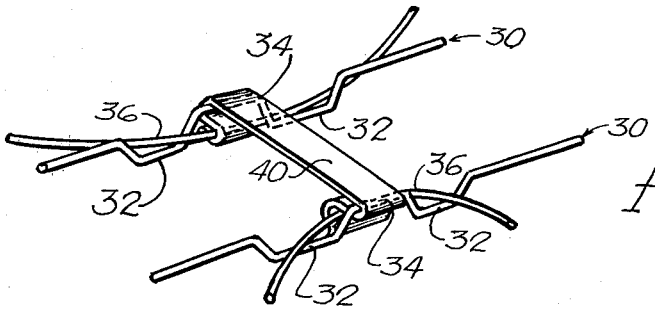
FIG. 3 is a perspective view of a portion of the assembly showing the clip of this invention in the attached position.

Referring now to the drawings, the spring cushion assembly 10 is formed of a plurality of helical coil springs 12 formed of spring wire. The coil springs can be of various types used in spring assemblies, such as coil springs formed of multiple coils to conical shape, cylindrical shape, or hourglass shape and the like.

The coil springs 12 are arranged in crosswire and lengthwise rows 14 and 16 within a border wire 18 and spring wire 20 is intertwined about the border wire and the adjacent portions of the terminal coils of the outermost corner springs in the rows to interconnect the outermost coil springs with the border wire.

The coil springs are interconnected in a manner to maintain the coil springs in the desired spaced relation in the crosswise and lengthwise extending rows 14 and 16 by means of tie wires 30 which extend crosswire in spaced apart relation corresponding with the spaced relation between the coil springs in the lengthwise extending rows 16, whereby the tie wires extend alongside the adjacent chord portions of the terminal coils of the coils springs in the lengthwise extending rows.

Each tie wire 30 is provided with a plurality of spaced depressions 32 with the portion 34 between the pairs of depressions being raised to form a saddle. In the assembled relation, the terminal coil 36 of the coil spring straddles the saddle with the adjacent portions of the terminal coils extending through the adjacent depressions 32 to seat the outer chord of the terminal coil onto the tie wire.

Figure 4:
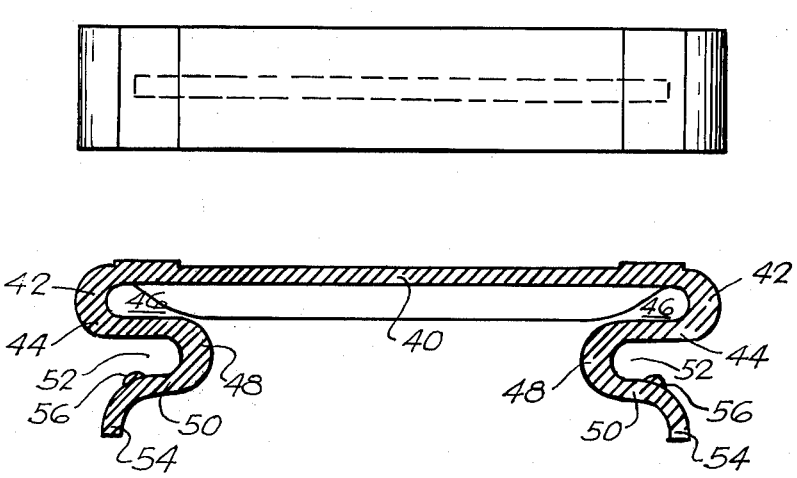
FIG. 4 is a side elevational view of the clip member embodying the features of this invention.

The clip of this invention operatively engages the saddle portion 34 and the chord portion 36 of the coil spring to intertie the coil spring with the tie wires, thereby to fix the coil spring in the desired location in the crosswise and lengthwise extending rows. The clip, representative of the preferred practice of this invention, as shown in FIG. 4, is formed of a thin flat strip of metal, plastic or the like material having some degree of flexibility. It includes a central body portion 40 dimensioned to have a length corresponding to the space relation between the adjacent tie wires 30. The central portion 40 terminates in a reversely bent portion 42 at each end which lead into inwardly extending portions 44 which extend for a short distance in spaced parallel relation with the underside of the body portion 40 to define inwardly facing channel sections 46 therebetween dimensioned to enable the tie wire 30 to be received in seated relation therein, when in the assembled relation.

The flat channel forming portions 44 are provided with reverse bends 48 at their ends which lead into a curvilinearly outwardly extending portion 50 in spaced relation from the bottom side of the portion 44 to provide outwardly facing channels 52 of increasing dimension to enable a portion of the saddle embracing portion of the terminal coil of the coil spring to be received therein, for retention, when in the assembled relation. The curvilinear outwardly extending portion 50 finally terminates in a downwardly and outwardly extending curvilinear tongue 54, which facilitates the insertion of the clip member from the direction inwardly of the coil spring outwardly through the space between the saddle 34 and the terminal coil of the coil spring and then downwardly to enable the tie wire 30 to snap into the upper channel 46 while the terminal coil of the coil spring is received within the outwardly facing channel 52. Thus the strip operates to retain the elements in their seated relation.

In the preferred practice, the portion of the curvilinear, outwardly extending, channel forming portion 52 is formed with an upwardly extending projection or ridge 56 over which the terminal coil portion snaps during displacement to become seated within the channel 52 and which is effective to militate against the coil portion slipping from the channel in response to flexing of the assembled spring during use.

In assembly, the coil springs 12 are arranged in the desired pattern of lengthwise and crosswire extending rows. The border wire 18 is positioned about the terminal coils of the outermost coil springs in the rows and the helical wires 20 are wound about the border wire and the adjacent terminal coil portions of the coil springs to effect an assembled relation therebetween.

The cross tie wires 30 are inserted so that the outer chords of the terminal coils of the coil springs in the crosswire rows rest in the spaced depressions 32 to embrace the saddle portion 34, thereby to locate the coil spring and the tie wires in the desired position for assembly.

First, the tongue 54, at one end of the clip, is inserted for interengagement of the tie wire and coil spring by insertion of the tongue from the inside in the direction outwardly and downwardly through the space between the saddle 34 and the outer chord of the coil spring, followed by rocking movement of the clip over the assembly with downward pressure, with the result that the saddle portion of the tie wire automatically comes to rest in the channel 46 while the portion of the coil spring embracing the saddle seats within the outwardly facing channel 52. It will be seen from the drawing that the body portion is formed with a depending rib that extends into the channel 46 and restricts the passage for entrapment of the saddle portion when it becomes seated therein.

In order to insert the other end of the clip into the space between the saddle and chord in the adjacent coil of the lengthwise row, it is necessary to distort the tie wire and terminal coil of the coil spring inwardly and downwardly to enable the tongue 54 to be inserted from the direction inwardly of the saddle into the space between the saddle and the embracing portion of the coil where, upon release, the saddle 34 naturally enters into the upper channel 46 while the saddle embracing portion of the coil spring enters into the outwardly facing channel 52.

Thus the clip of the invention results in an assembly relation which can be achieved in a simple and efficient manner by comparison with the clip described in the aforementioned issued patent, while more effectively securing the elements in their assembled relation to prevent disengagement during flexure of the spring during normal use.

The tie wires may be connected at their ends to the border wires, as by welding or by means of a clip or merely by twisting about the border wire, but, in the preferred practice, the ends of the tie wires are free from the border wire to enable greater flexibility in the spring assembly.

The other ends of the coil springs are usually anchored onto strips S, in an upholstered piece or cushion, or to frame members in a spring assembly or mattress.

It will be understood that changes may be made in the details of the construction arrangement and operation, without departing from the spirit of the invention, especially as defined in the following claims.

We claim:

1. In a spring assembly having a plurality of coil springs arranged in lengthwise amd crosswise extending rows, means interconnecting spaced pairs of coil springs in a row comprising a pair of spaced parallel tie wires which intersect as chords adjacent terminal coils of the adjacent pairs of coil springs in the row, and a clip member formed of an integral relatively flat strip having a central body portion dimensioned to correspond to the spaced relation between the tie wires, a reversely bent and an inwardly extending portion in spaced substantially parallel relation with the body portion on the ends of the body portion to provide inwardly facing channels, a reversely bent portion and outwardly extending portion on the end of the inwardly extending portion in spaced relation to the inwardly extending portion to provide outwardly facing channels of increasing dimension, a projection at the end of the outwardly extending portion which extends in the direction toward the inwardly extending portion by an amount wherein the spaced relation between the projection and the inwardly extending portion is less than the cross section of the member to be seated in the outwardly facing channel, and a tongue at the end portion of the outwardly extending portion and extending curvilinearly outwardly and in the direction away from the inwardly extending portion to provide an entrant member for the clip whereby, in the assembled relation, the tie wires and portions of the terminal coils of the pair of coil springs are seated within respective channel sections and a rib extending lengthwise along the body portion into the inwardly facing channels to restrict the passage therein.

2. A spring assembly as claimed in claim 1 in which the tie wires include downwardly spaced portions and a raised saddle portion in between which is embraced by the outermost portion of the terminal coil of the coil spring when the adjacent portions of the coil spring are seated in the downwardly spaced portions in the assembled relation.

3. A spring assembly as claimed in claim 2 in which the saddle portions are seated within the inwardly facing channels and the portions of the coil springs are seated in the outwardly facing channels when in the assembled relation.

4. A spring clip formed of an integral flat metal strip having a central body portion, portions extending from the ends of the body portion in sequence in a reverse bent portion and an inwardly extending portion spaced below the body portion to provide opposite inwardly facing channels, a reversely bent portion and outwardly extending portion spaced below the inwardly extending portion to provide opposite outwardly facing channels, a projection near the end of the outwardly extending portion extending in the direction of the inwardly extending portion to decrease the spaced relation therebetween, and a tongue extending curvilinearly downwardly and outwardly from the end of the outwardly extending portion, and a rib extending lengthwise along the body portion into the inwardly facing channels to restrict the passage therein.

* * * * *